United States Patent [19]

Koike et al.

[11] 4,104,496

[45] Aug. 1, 1978

[54] VACUUM INTERRUPTER DEVICE

[75] Inventors: Hiroshi Koike, Tama; Hideaki Wakayama, Fuchu; Hiroshi Ohashi, Tokyo; Kunio Yokokura, Fuchu, all of Japan

[73] Assignee: Tokyo Shibaura Electric Co., Ltd., Kawasaki, Japan

[21] Appl. No.: 760,424

[22] Filed: Jan. 18, 1977

[51] Int. Cl.[2] ..... H01H 33/66

[52] U.S. Cl. ..... 200/144 B; 200/144 AP

[58] Field of Search ..... 200/144 B, 144 AP, 147 R, 200/145

[56] References Cited

U.S. PATENT DOCUMENTS

| | | | |
|---|---|---|---|
| 3,590,186 | 6/1971 | Brunner | 200/144 AP |
| 3,823,288 | 7/1974 | Wilson | 200/144 B |
| 3,921,109 | 11/1975 | Hodgson | 200/147 R |

FOREIGN PATENT DOCUMENTS

| | | | |
|---|---|---|---|
| 670,082 | 10/1964 | Italy | 200/144 AP |

*Primary Examiner*—Robert S. Macon

*Attorney, Agent, or Firm*—Cushman, Darby & Cushman

[57] ABSTRACT

In this vacuum interrupter device, one or more upper terminals and lower terminals connected to a vacuum interrupter built in the device are attached to an insulating barrier which is provided with a plurality of chambers opening outward and capable of being closed by removable covers. In each of said chambers is placed one of non-linear resistors as many as said upper or lower terminals, one end of each of said resistors being connected to one of the upper or lower terminals corresponding thereto which is connected to the electric load, thereto and another end of each of said resistors being grounded through a switch.

6 Claims, 6 Drawing Figures

VACUUM INTERRUPTER DEVICE

BACKGROUND OF THE INVENTION

This invention relates to a vacuum interrupter device in which a non-linear resistor or resistors for suppressing surge caused by make and break of the vacuum interrupter may be placed and removed easily. In order to suppress make-and-break surges of the conventional vacuum interrupter, a CR suppressor composed of a resistance and a capacitor connected in series was usually connected between the load side terminal and the ground. The CR suppressor, however, had a drawback that it could not be contained without extension of the panel of the interrupter device or use of a larger panel because of its large size, thereby requiring a large space.

In order to avoid the above-mentioned drawback, there was considered use of a relatively small non-linear resistor instead of the CR suppressor. Such resistor, e.g., composed of metallic oxide containing zinc oxide (ZnO) as a main component, usually has a high resistance, though, if applied with an overvoltage above the prescribed level, the resistance will be decreased quickly and reduced in performance as a high-resistor to suppress the overvoltage substantially to a prescribed lower level.

Usually a vacuum interrupter device is equipped with at least a pair of terminals, one of which is an upper terminal and the other of which is a lower terminal. For example, when a plurality of devices for use in three-phase circuit are used in a state piled up in an enclosed-type power board, electrical load must be connected to the upper terminals or lower terminals of the device according to the piled position thereof. Therefore, in the vacuum interrupter device, connections of the non-linear resistors with the terminals are required to be easily changed from any one of the upper terminals to a corresponding one of the lower terminals or vice versa. In the prior art, however, there existed no such vacuum interrupter device as may fullfil the above-mentioned requirements satisfactorily.

SUMMARY OF THE INVENTION

An object of this invention is to provide a vacuum interrupter device in which a non-linear resistor may be placed and removed easily between any terminal of the vacuum interrupter and the ground so as to suppress make-and-break surge caused by the vacuum interrupter.

In order to attain the above-mentioned object, the vacuum interrupter device of this invention is provided with a frame, an insulating barrier erected on said frame; a pair of terminals attached to said barrier which are to be connected to a main electric circuit; a chamber provided at the vicinity of said two terminals; a vacuum interrupter connected between said two terminals; an operating means to operate the vacuum interrupter; a non-linear resistor placed in said chamber connected between either one of the two terminals and the ground to lead make-and-break surges caused by said vacuum interrupter to the ground.

Use of this vacuum interrupter device may provide advantages that the device may be miniaturized by using the relatively small non-linear resistor, that said resistor may be replaced easily with a new one, that, where a cover is mounted to close the chamber, the high-voltage portions connected to the main circuit may be saved from exposure to the outside, and that said resistor may be connected to either one of the terminals or the other terminal optionally with ease.

If said vacuum interrupter device of the invention is provided with plurality of terminal pairs, chambers, non-linear resistors, it will be able to be used for make and break of a plurality of circuits or two, three or more circuits and hence two-phase or three-phase circuits, etc.

Further, if a switch is connected between the non-linear resistor and the ground the non-linear resistor is prevented, by opening the switch to separate the resistor from the ground, from being damaged as a result of an insulation resistance test and withstand voltage test of the vacuum interrupter device. Further, if a surge detector is connected in series with the switch, and an output of the surge detector is led to the surge counter, the number of surges applied to the non-linear resistor are counted and recorded, thus the life of the resistor is monitored.

DETAILED DESCRIPTION OF THE PREFERRED EMBODIMENTS

Figure 1:
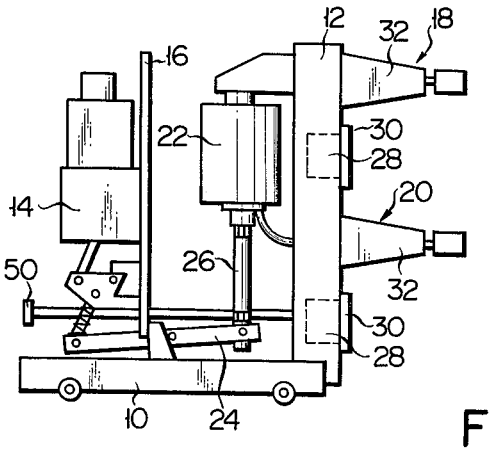
FIG. 1 is a side view of the vacuum interrupter device of this invention illustrative of the overall construction.
Figure 2:
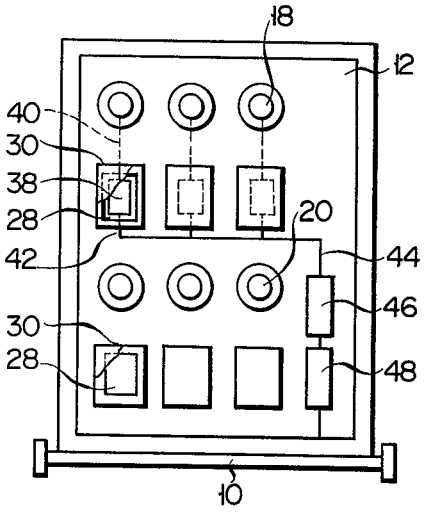
FIG. 2 is a rear view of the vacuum interrupter device for three-phase circuit where three non-linear resistor are connected with the upper terminals.

The following embodiment is of the vacuum interrupter device for three-phase circuit according to this invention. Referring to FIGS. 1 and 2, an insulating barrier 12 is erected in back of a movable frame 10 or on the right as shown in FIG. 1, while a mounting plate 16 equipped with an operating means 14 is erected on the left or in front of the insulating barrier 12 at a distance therefrom. The insulating barrier 12 is provided with each three upper terminals 18 and lower terminals 20 extending backward. The three upper terminals 18 are arranged horizontally in a line at the upper end portion of the insulating barrier 12, while the three lower terminals 20 are arranged horizontally in a line below said upper terminals 18 at a distance therefrom. In front of said insulating barrier 12 is provided a vacuum interrupter 22 connected between the upper terminals 18 and lower terminals 20, said vacuum interrupter 22 being capable of making and breaking the main circuit, namely, a circuit connected from a power source (not shown) to a load (not shown) through the upper terminals 18, vacuum breaker 22 and lower terminals 20. Operation of said vacuum interrupter may be performed by the operating means 14 for make and break through a link means 24 and a switching insulating rod 26 driven by said means 24.

The insulating barrier 12 is provided with chambers 28 opening backward below the upper terminals 18 and lower terminals 20 respectively. The chambers 28 provided below the upper terminals 18 will be referred to as upper chambers hereinafter, while the chambers 28 provided below the lower terminals 20 will be referred to as lower chambers. The openings of the chambers 28, are closed by covers 30 made of electrically insulating material and removably attached thereon respectively.

Figure 3:
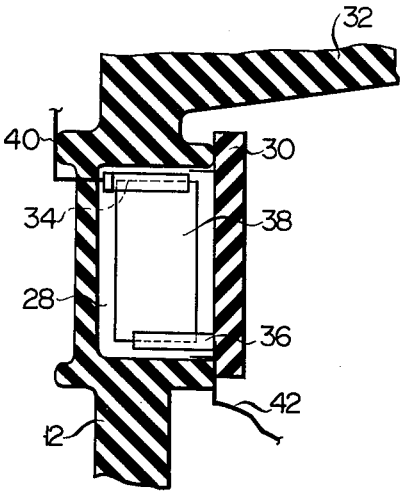
FIG. 3 is a cross-sectional side view illustrative of a condition of the non-linear resistor attached within the chamber provided in the insulating barrier.

FIG. 3 illustrates a portion of said chamber 28 in detail. Numeral 32 indicates a bushing provided for each of the upper terminal 18 and lower terminal 20 (see FIG. 1). At the interior top and bottom portions of the chamber 28 are attached supporting members 34 and 36 connected with the main circuit side and with the grounding side respectively. The upper and lower ends of a non-linear resistor 38 placed in the chamber 28 are attached removably to said supporting members 34 and 36 respectively. A lead wire 40 connected with said supporting member 34 is connected to the upper terminal 18 or lower terminal 20 located above it.

FIG. 2 illustrates connection where a non-linear resistor 38 is placed in each of the three chambers 28. In this case, the upper terminals 18 are connected to the three-phase load, and the supporting members 34 are connected to the respective upper terminals 18 by the lead wires 40, while the lead wires or grounding conductors 42 connected respectively with the supporting members 36 are put together into a single lead wire or grounding conductor 44 and grounded through a surge detector 46 and a switch 48. The vacuum interrupter device prevents effectively surges which may be caused when the vacuum interrupter 22 is made or broken from spreading to the three-phase load.

Though the switch 48 is closed in the normal condition, it may be broken by operating a handle 50 as shown in FIG. 1 when the vacuum interrupting device is submitted to an insulation resistance test or withstand voltage test. Such breaking operation of the switch will separate all the non-linear resistors 38 from ground to avoid deterioration or failure of the non-linear resistors 38 due to overvoltage applied thereupon in the above tests.

The surge detector 46 may be used for detecting surges which will be caused by the vacuum interrupter 22, and a conventional current transformer or shunt is employed in association therewith. The output of the surge detector 46 is led by a surge counter (not shown) capable of counting and recording the operating frequency of said non-linear resistors 38 and monitoring the life of said resistors.

Figure 4:
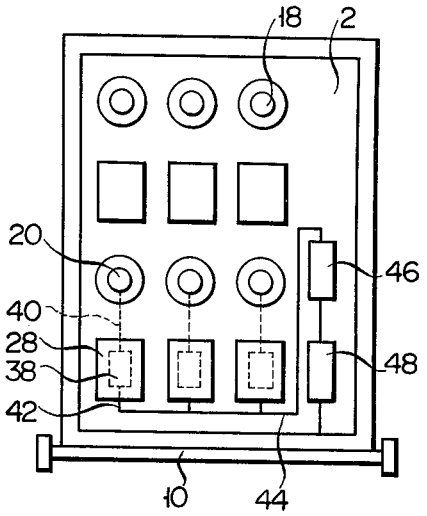
FIG. 4 is a rear view of the vacuum interrupter device for three-phase circuit where three non-linear resistor are connected with the lower terminals.

In the vacuum interrupter device as shown in FIG. 4, a non-linear resistor 38 is placed in each of the three lower chambers 28. In this case, the lower terminals 20 are connected to the three-phase load, and the supporting members 34 are connected to the respective lower terminals 20 by the lead wires 40, while the three lead wires or grounding conductors 42 connected respectively with the supporting members 36 are put together into a single lead wire or grounding conductor 44 and grounded through a surge detector 46 and a switch 48. This device prevents effectively make-and-break surges by the vacuum interrupter 22 from spreading to the three-phase load. The surge detector 46 and the switch 48 function in the same manner as stated above.

When every one of the chambers 28 is provided with the supporting members 34 and 36 connected as shown in FIG. 2 and FIG. 4, connection of FIG. 2 or FIG. 4 is easily obtained by inserting the non-linear resistors 38 between the supporting members 34 and 36 of the upper chambers or lower chambers.

In either of the connecting systems as shown in FIGS. 2 and 4, there may be obtained such effects that the device may be miniaturized by using the relatively small non-linear resistors 38, that said resistor 38, if deteriorated or damaged, may be replaced easily with new one by removing the cover 30 and taking away from the supporting members 34 and 36, that said resistors 38, even if the terminals to be connected with the three-phase load should be changed from upper terminals 18 to lower terminals 20 or vice versa, can be easily connected with the resultant terminals, that the non-linear resistor 38 connected to the main circuit including the upper terminal 18 or lower terminal 20 is contained in the chamber 28 closed by the cover 30 and the lead wire 40 for connecting said resistor 38 with said main circuit is arranged in back of the insulating barrier 12 as viewed from the cover 30 side, thereby assuring safety, that the non-linear resistor 38 may be disconnected from the ground by operating the switch 48 in submitting this device to an insulating resistance test or withstand voltage test, and that the number of surges applied on said resistors 38 may be countered and recorded, thus its life may be monitored by using the surge detector 46.

Figure 5:
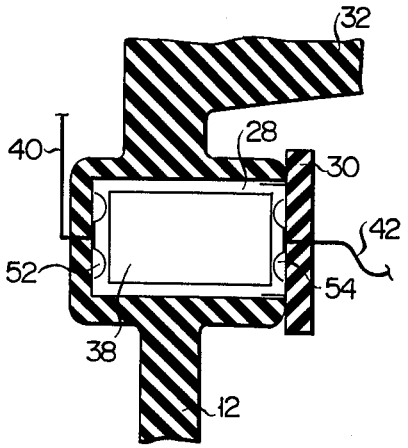
FIG. 5 is a cross-sectional side view illustrative of another condition of the non-linear resistor attached within the chamber provided formed in the insulating barrier.

It is to be understood that the invention is not limited to the above-described embodiments, and that various changes and modifications may be effected thereon by one skilled in the art without departing from the scope or spirit of the invention. For instance, as shown in FIG. 5, the non-linear resistor 38 may be inserted horizontally into the chamber 28 arranged in the insulating barrier 12 so that said resistor 38 may be held elastically between an elastic contact 52 fixed to the wall of the chamber 28 and an elastic contact 54 fixed to the cover 30 made of an electrically insulating material. The lead wire 40 connected with the contact 52 is connected to the upper terminal 18 or lower terminal 20 located above it, while the lead wire 42 connected with the contact 54 is drawn out through the cover 30 and grounded together with other lead wires 42 through the surge detector 46 and the switch 48 (see FIGS. 2 and 4). Such a construction may allow the cover 30 and the contact 54 to be removed at the same time, so that the non-linear resistor 38 may be replaced easily.

Figure 6:
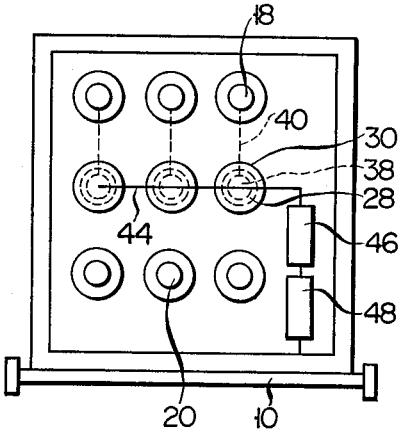
FIG. 6 is a rear view of the vacuum interrupter device for three-phase circuit where three common chambers are provided between the upper terminals and lower terminals.

Meanwhile as shown in FIG. 6, the chamber 28 (of the type as shown in FIG. 5) may be arranged between the upper terminal 18 and the lower terminal 20 so that the lead wire 40 of the non-linear resistor 38 inserted into the chamber 28 may be connected optionally to the upper terminal 18 or lower terminal 20. Such a construction may reduce the number of the chambers 28 and also reduce the size of the insulating barrier 12 and hence the device as a whole. In FIG. 6, the lead wire 40 is shown to be connected to the upper terminal 18.

In the above described embodiments, the lead wire 42 are connected together and grounded through one switch 48, but a switch 48 may be provided in each lead wire 42.

Further, a surge detector 46 may be connected in series to each switch 48, then the surge number through each resistor 38 is capable of being counted and recorded by using a surge counter connected with the surge detector 46, thus monitoring the life of the non-linear resistor.

In the above embodiments, chambers 28 are provided in the insulating barrier 12, but the chambers 28 may be provided in the bushings of the upper terminals and/or lower terminals.

What we claim is:

1. A vacuum interrupter device comprising a frame; an insulating barrier erected on said frame; a pair of terminals attached to said barrier which are to be connected to a main electric circuit; a chamber provided at the vicinity of said pair of terminals; a vacuum interrupter connected between said pair of terminals; an operating means to operate the vacuum interrupter; a non-linear resistor placed in said chamber connected between either one of the pair of terminals and the ground to lead make-and-break surges caused by said vacuum interrupter to the ground.

2. A vacuum interrupter device according to claim 1, in which said chamber is provided, in the insulating barrier, between said pair of terminals, and the non-linear resistor placed in the chamber is selectively connected between either one of said pair of terminals and the ground.

3. A vacuum interrupter device according to claim 1, wherein said chamber is provided one for each terminal.

4. A vacuum interrupter device according to claim 1, which further comprises a switch connected between the non-linear resistor and the ground.

5. A vacuum interrupter device according to claim 1, which further comprises a surge detector connected between the non-linear resistor and the ground.

6. A vacuum interrupter device suited for make and break of three-phase circuit comprising a movable frame; an insulating barrier erected on said frame, three upper terminals and lower terminals attached to said barrier; at least three chambers provided in said barrier at the vicinity of said upper and lower terminals; at least three covers made of an electrically insulating material attached removably to said chambers; a vacuum interrupter connected between said upper and lower terminals; an operating means to operate the vacuum interrupter; three non-linear resistors placed in said chambers each connected between the ground and either one of said upper terminals and lower terminals to lead make-and-break surge caused by said vacuum interrupter; three grounding conductors each connected to another terminal of each of said three resistors; and a switch connected between said three grounding conductors and the ground and capable of breaking connection between said resistors and the ground; and a surge detector connected in series with said switch.

* * * * *